US005275399A

United States Patent [19]

Schmidt et al.

[11] Patent Number: 5,275,399

[45] Date of Patent: * Jan. 4, 1994

[54] GOLF CLUB HEAD TO SHAFT CONNECTION

[75] Inventors: Glenn H. Schmidt, Malibu; Richard C. Helmstetter, Carlsbad, both of Calif.

[73] Assignee: Callaway Golf Company, Carlsbad, Calif.

[ * ] Notice: The portion of the term of this patent subsequent to Nov. 24, 2009 has been disclaimed.

[21] Appl. No.: 973,944

[22] Filed: Nov. 9, 1992

Related U.S. Application Data

[63] Continuation of Ser. No. 743,432, Aug. 9, 1991, Pat. No. 5,165,688.

[51] Int. Cl.[5] ..... A63B 53/02

[52] U.S. Cl. ..... 273/80 B; 273/80.2; 273/80.6

[58] Field of Search ..... 273/80.1-80.9, 273/167 R-177 A, 80 R, 80 B, 77 R, 164.1, 162 R

[56] References Cited

U.S. PATENT DOCUMENTS

| | | | |
|---|---|---|---|
| D. 234,963 | 4/1975 | Hirata | D21/220 |
| 1,639,547 | 8/1927 | Barnhart | 273/80.4 |
| 1,658,581 | 2/1928 | Tobia | 273/169 |
| 1,892,482 | 12/1932 | Cash | 273/80.4 |
| 1,895,417 | 1/1933 | Lard | 273/80.4 |
| 1,980,031 | 11/1934 | Brading | 273/80.6 |
| 2,018,898 | 10/1935 | Reach | 273/80.4 |
| 2,067,556 | 1/1937 | Wettlaufer | 273/79 |
| 2,087,685 | 7/1937 | Hackney | 273/169 |
| 2,100,307 | 11/1937 | McMinn | 273/80 B |
| 2,203,893 | 6/1940 | Chapman | 273/167 K |
| 2,231,847 | 2/1941 | Dickson et al. | 273/80 C |
| 3,068,011 | 12/1962 | Sano | 273/167 A |
| 3,661,388 | 5/1972 | Leslie | 273/80.2 |
| 3,897,065 | 7/1975 | Solheim | 273/167 A |
| 3,947,041 | 3/1976 | Barber | 273/167 G |
| 4,169,595 | 10/1975 | Kaugars | 273/80 R |
| 4,214,754 | 7/1980 | Zebelean | 273/167 H |
| 4,432,549 | 2/1984 | Zebelean | 273/167 H |
| 4,470,600 | 9/1984 | Parente et al. | 273/80.2 |
| 4,512,577 | 4/1985 | Solheim | 273/77 A |
| 4,632,400 | 12/1986 | Boone | 273/164 |

(List continued on next page.)

FOREIGN PATENT DOCUMENTS

| | | |
|---|---|---|
| 344031 | 2/1989 | France . |
| 2626187 | 7/1989 | France . |
| 208553 | 6/1924 | United Kingdom . |
| 267398 | 4/1927 | United Kingdom . |
| 371974 | 5/1931 | United Kingdom . |
| 2144042 | 2/1985 | United Kingdom . |
| 2230459 | 10/1990 | United Kingdom . |
| 8606286 | 11/1986 | World Int. Prop. O. . |

OTHER PUBLICATIONS

"The Wilson Staff Dynapower Iron", Time Magazine, Mar. 24, 1967, European Patent WO 88/01525 to Des-Biolles et al., Mar. 10, 1988.

"Some of our Best Friends are Hookers and Pushers", Golf World, Jan. 1974, p. 45.

"The Ounce That Counts", Golf World, Jan. 24, 1975, pp. 46 & 47.

"Stroke-Savers", Golf Digest, Mar. 1988, pp. 82-83.

*Primary Examiner*—Theatrice Brown
*Assistant Examiner*—Sebastiano Passaniti
*Attorney, Agent, or Firm*—William W. Haefliger

[57] ABSTRACT

A golf club having a head and a shaft, an improved connection of the shaft to the head comprising a socket associated with the head, the socket having an inner wall tapering in an endwise direction generally toward the bottom of the head; the shaft having a lower end portion with circularly spaced cantilevered sections, and endwise extending slots formed between the sections; the cantilevered sections forcibly received endwise into the socket causing the sections to be deflected by the socket inner wall to reduce the width of the slots proximate lower ends of the sections closest to the bottom of the head.

34 Claims, 4 Drawing Sheets

U.S. PATENT DOCUMENTS

| | | | |
|---|---|---|---|
| 4,635,941 | 1/1987 | Yoneyama | 273/78 |
| 4,854,581 | 8/1989 | Long | 273/77 A |
| 4,854,582 | 8/1989 | Yamada | 273/80.2 |
| 4,872,685 | 10/1989 | Sun | 273/169 |
| 4,913,435 | 4/1990 | Kobayashi | 273/77 A |
| 4,930,781 | 6/1990 | Allen | 273/167 F |
| 4,948,132 | 8/1990 | Wharton | 273/80.1 |
| 4,955,610 | 9/1990 | Creighton et al. | 273/169 |
| 4,957,294 | 9/1990 | Long | 273/167 H |
| 4,958,834 | 9/1990 | Colbert | 273/77 A |
| 4,984,794 | 1/1991 | Pernelle et al. | 273/79 |
| 4,986,541 | 1/1991 | Teramoto et al. | 273/77 A |
| 4,995,609 | 2/1991 | Parente et al. | 273/80.2 |
| 5,165,688 | 11/1992 | Schmidt | 273/80.2 X |

10
11a
21
12
13
14
11
11b
36
37
15
16

10
12
11a
11
11b
32a
16
36
50
49

GOLF CLUB HEAD TO SHAFT CONNECTION

This is a continuation of application Ser. No. 743,432 filed Aug. 9, 1991, now U.S. Pat. No. 5,165,688.

BACKGROUND OF THE INVENTION

This invention relates generally to golf clubs, and more particularly to connection of a golf club head to a shaft to achieve certain advantages.

Many efforts have been made to reallocate metallic weight from the hosel area of a golf club to the head itself, in order to achieve higher energy availability for transfer when the club is swung. Such greater energy or momentum is then transferred to the golf ball when struck. This requires, for example, reduction of metal at the hosel area of the club.

Such efforts have included configurations wherein a shaft passed through the head of a persimmon wood. Typical of such configurations were: Wilson's staff model "Dynopower Fluid Feel" wood, produced around 1957; Wilson's "Helen Hicks" wood, produced in the 1920's; and certain MacGregor woods produced in the late 1930's. See also U.S. patent application Ser. No. 204,704 entitled "Iron Golf Club Heads", assigned to Callaway Golf Company, disclosing a hosel characterized by reduced mass or weight.

No way was known, to our knowledge, to connect a shaft to a golf club iron head, where the shaft passed to the bottom of the head and was reduced in diameter at or near the sole of the head so as not to interfere with an edge or edges of the sole; also, no way was known to connect such a shaft to a specially non-constant tapered bore in an iron hosel to provide a tight interference fit along the shaft and bore, upon axial assembly, enabling very good tactile "feedback" sensing, to the player, of head to ball impact.

SUMMARY OF THE INVENTION

It is a major object of the invention to provide an improved connection between a golf club head and shaft which meets the above needs, the head typically being an iron, such term also referring to a wedge, chipper, putter, wood, or other type. Basically, the invention includes or comprises:

a socket in the club head, the shaft having a lower end portion that extends into the socket and has walls collapsed therein toward one another to form a tight connection. Such walls may be formed by shaft cantilevered sections or tongues frictionally engaging the socket which may be downwardly tapered in the head, as to a location near the bottom of the head. This takes advantage of head metal to form the tapered socket interiorly of the head, whereby metal weight is saved and may be redistributed to other head locations, and whereby the tight connection is formed closer to the point of ball impact with the head.

As will be seen, the socket may have intersection with the bottom of the head, the section lower ends closing toward one another at or near that intersection, whereby a limit or resistance to collapse of the cantilever sections is produced along with formation of a frictionally jammed together connection, the latter also enhanced by adhesive bonding. In this regard, the sections lower ends typically may have lateral interengagement proximate the intersection. The lower end of the shaft alternatively may not intersect the bottom of the head.

Another object is the provision of spacial relationship of the hosel/face leading edge junction, characterized by desired continuity while allowing for socket-sole intersection, achieved without interruption of such leading edge continuity.

A further object is the provision of a graphite shaft tapered end connection to a head hosel, as will be seen.

These and other objects and advantages of the invention, as well as the details of an illustrative embodiment, will be more fully understood from the following specification and drawings, in which:

DRAWING DESCRIPTION

Figure 6:
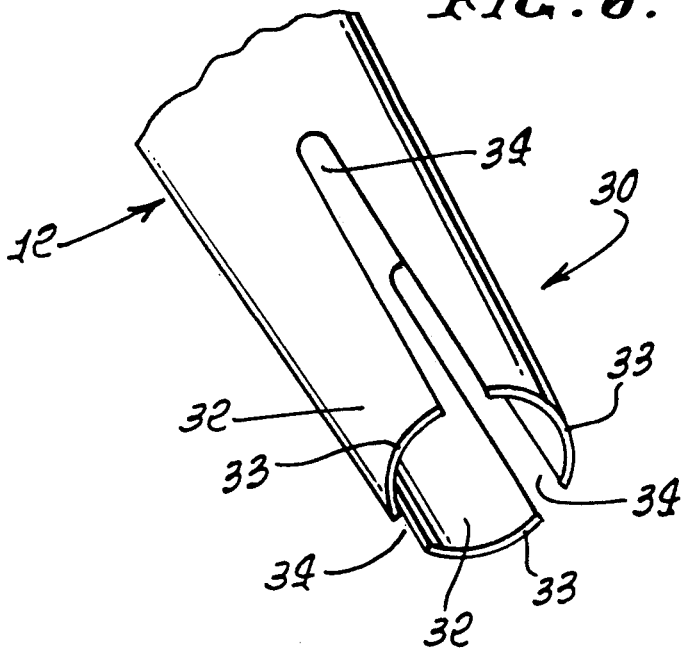
FIG. 6 is a perspective view of the shaft lower end before its reception into the hosel and tapered socket.
Figure 6A:
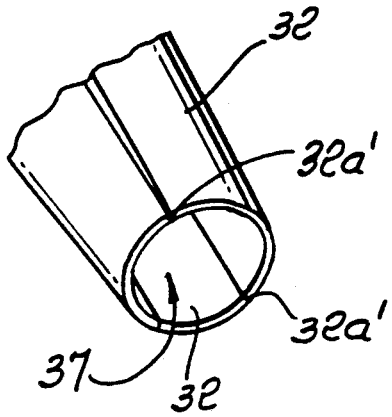
Figure 7:
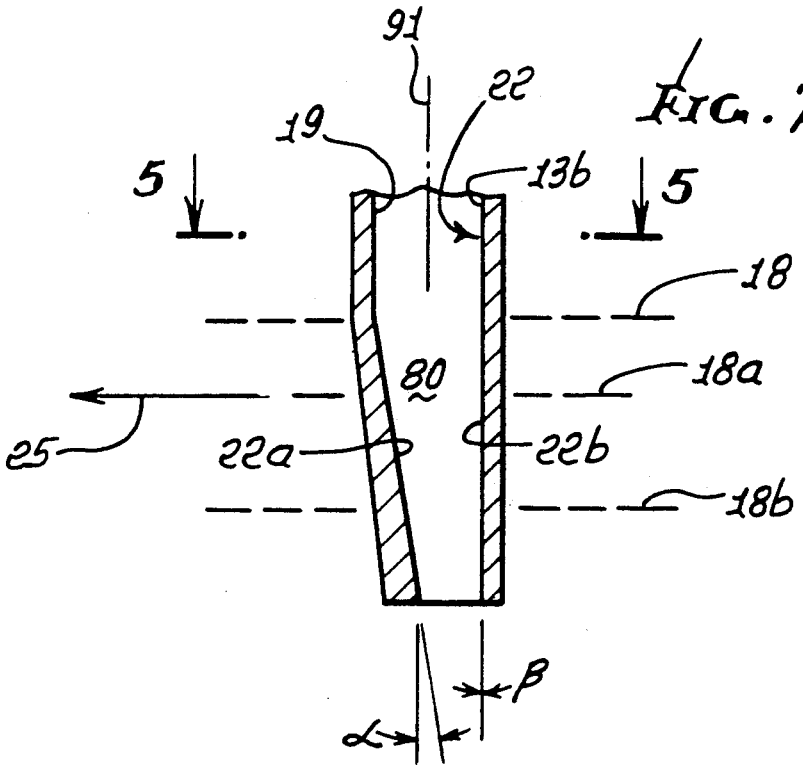
Figure 9:
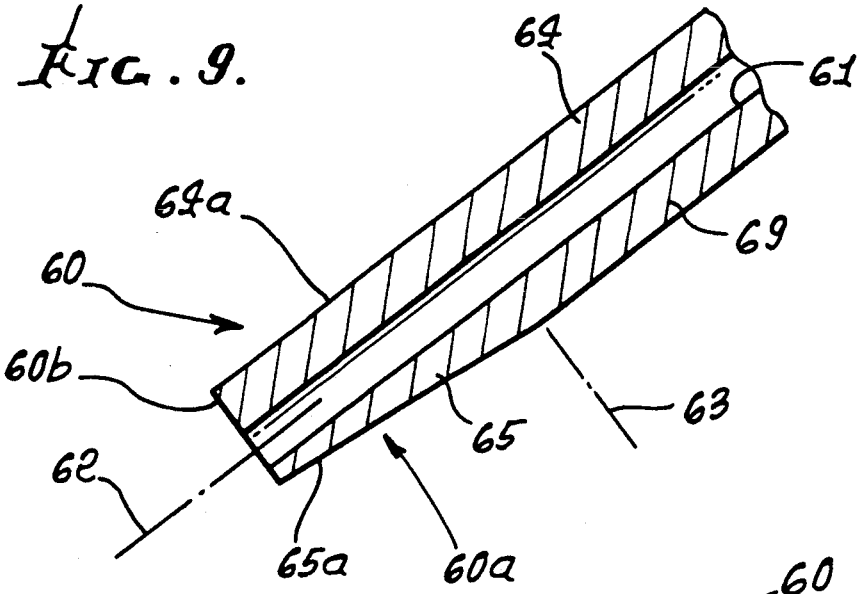
Figure 8:
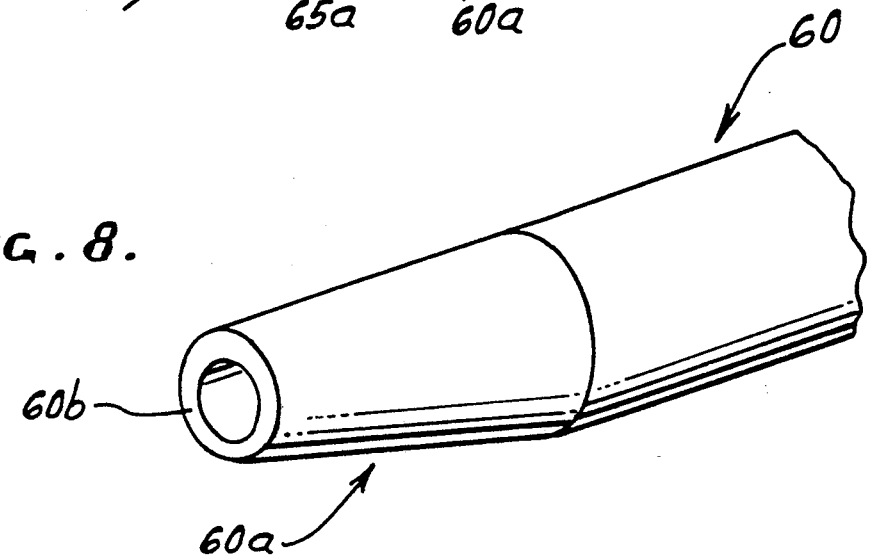

FIG. 6*a* is like FIG. 6 but shows shaft cantilever portions closed together at their lower ends;

FIG. 7 is a vertical section taken through the tapered socket in the lower end of the hosel;

FIG. 8 is a fragmentary perspective view of a tapered graphite shaft;

FIG. 9 is an endwise cross section taken through the FIG. 8 shaft; and

Figure 10:
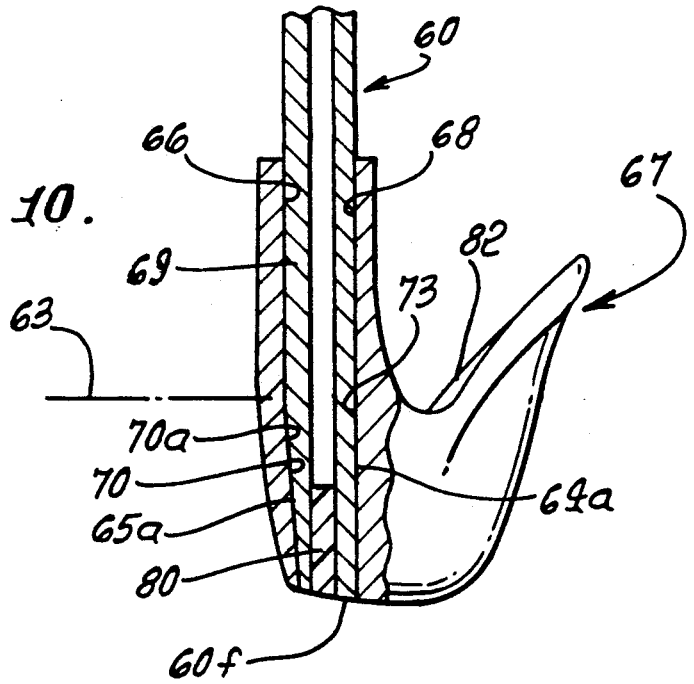

FIG. 10 is a view showing the FIG. 8 shaft assembled into a club head.

DETAILED DESCRIPTION

In the drawings, a golf club 10, such as an iron, has a head 11 and a ferrule 12. Also shown is a hosel 13, typically formed or cast as part of the head, the latter consisting of metal or other material. A socket 14 is associated with the head and has an inner wall, the lower extent of which tapers in an endwise downward direction, generally toward the bottom 15 of the head at the heel. In this regard, the socket preferably has intersection at 16 with the head bottom 15, proximate heel 11*b*, that intersection typically being oval shaped due to angularity of bottom 15 relative to the socket axis.

Figure 4:
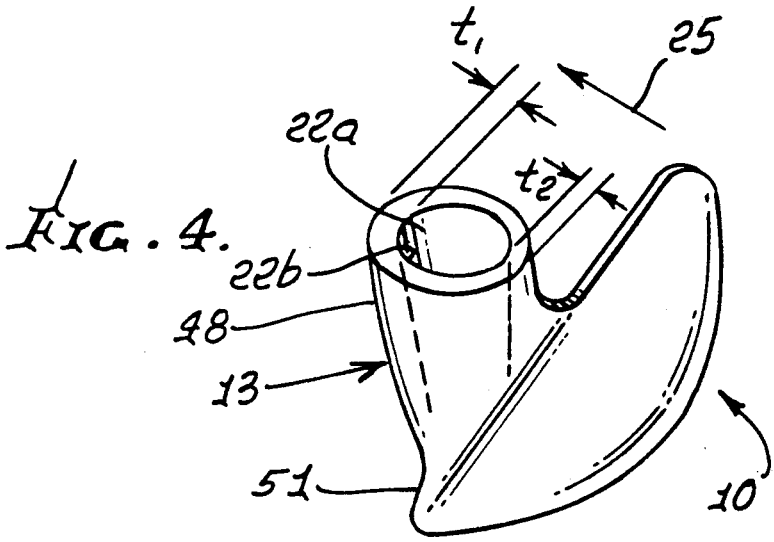
FIG. 4 is a rear end perspective view of the section of the FIGS. 1-3 head and hosel.
Figure 5:
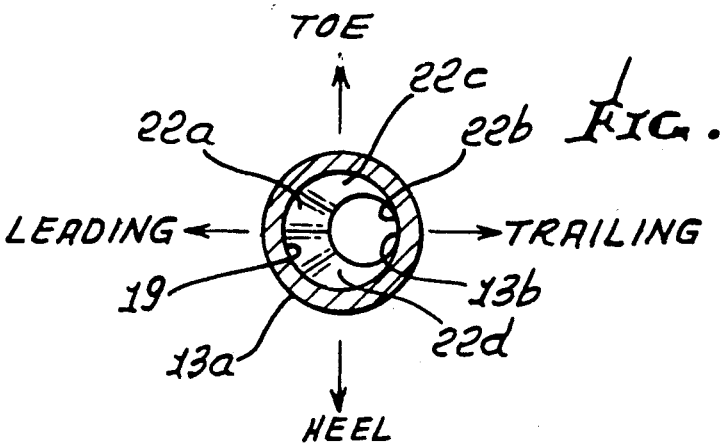
FIG. 5 is a top plan view taken at the upper end of the hosel.

FIGS. 5 and 7 show that the socket taper commences at a zone indicated by line or plane 18 below a lengthwise straight, circular cross section bore 19 in the hosel and that extends from the upper end 21 of the hosel to horizontal plane 18. Bore 19 may be conical. The taper angle of the socket interior wall 22 preferably varies as for example appears in FIGS. 5 and 7, though such variable taper may approach zero, defining a cone. Thus, the forward (leading) side 22*a* of wall 22 has relatively greater taper angularity $\alpha$, relative to vertical, and the rearward (trailing) side 22*b* of the wall 22 has relatively lesser angularity $\beta$ (typically zero) relative to vertical, providing differential tapers, as shown. The taper angles of wall sides 22*c* and 22*d* lie between $\alpha$ and $\beta$. Thus, the tapered bore 80 is eccentric relative to the cylindrical outer surface 13*a* of the upper hosel, above plane 18, and relative to the hosel bore 13*b* above that plane. Further, the socket bore cross sections are circular or near circular, as at planes 18*a* and 18*b* parallel to 18, which are normal to hosel axis 91. In this regard, the forward stroking direction is that indicated by arrow 25 in FIGS. 4, 5 and 7, i.e., the direction toward which the head front face 11*a* faces (the ball striking direction). Angle $\beta$ may be reduced to zero, as for a cylindrical shaft, or may be equal to a standard taper (0.00375 inches per inch of length on one side). Angle $\alpha$ is between about 1 to about 8 degrees.

Further in this regard, the wall thickness of the hosel above plane 18 may also vary, as indicated, and may be circular, conical, or elliptical, for example. Thus, the thickness $t_1$ at the forward side of the hosel may be about the same as or greater than the thickness $t_2$ at the rearward side of the hosel. This relationship may be produced by forming bore 19 eccentrically relative to the cylindrical outer surface of the hosel, or it may be non-cylindrical or ellipsoidal. The main axis of the bore/shaft and the main axis of the outer configuration of the hosel proper may be approximately aligned or slightly skewed. These relationships contribute to a spacial relationship of the hosel to the head face leading edge juncture 50 and 51 allowing reallocation of weight to the head itself (i.e., between the toe, top, and sole area) for greater or more focussed momentum during club swinging.

Figure 1:
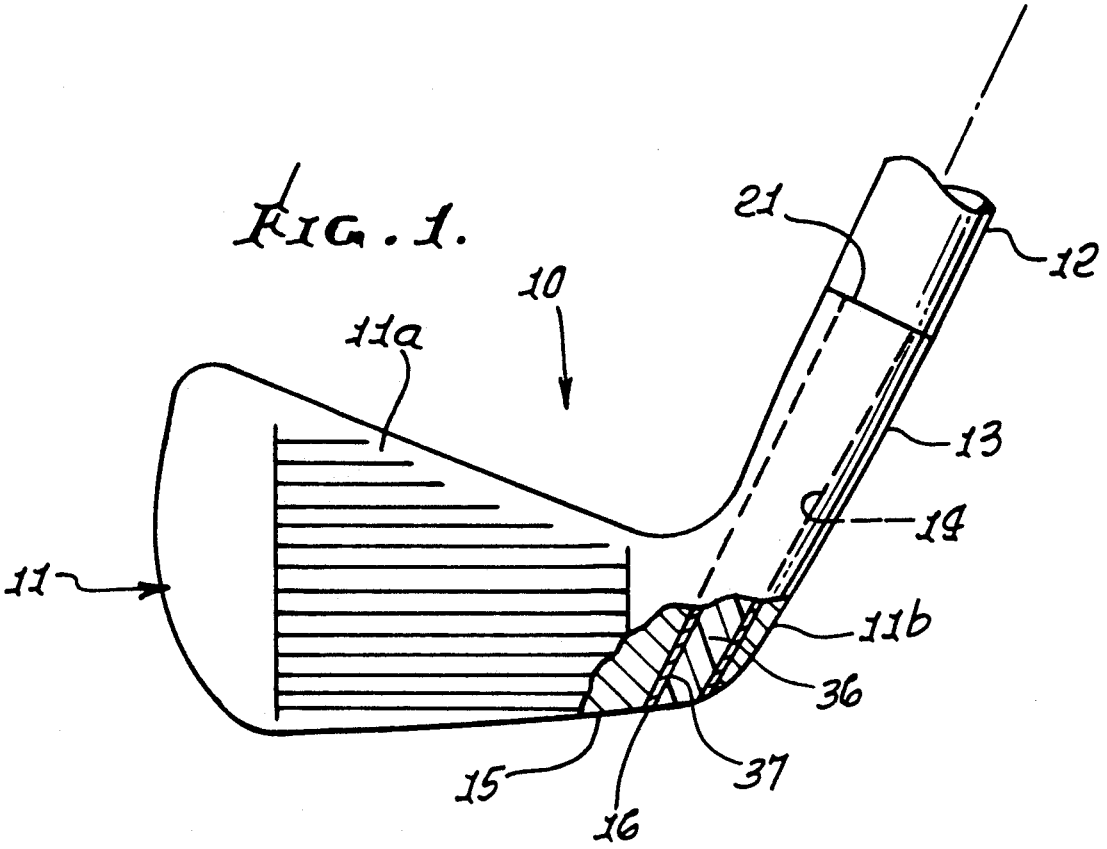
FIG. 1 is an elevation showing a golf club incorporating the invention.
Figure 2:
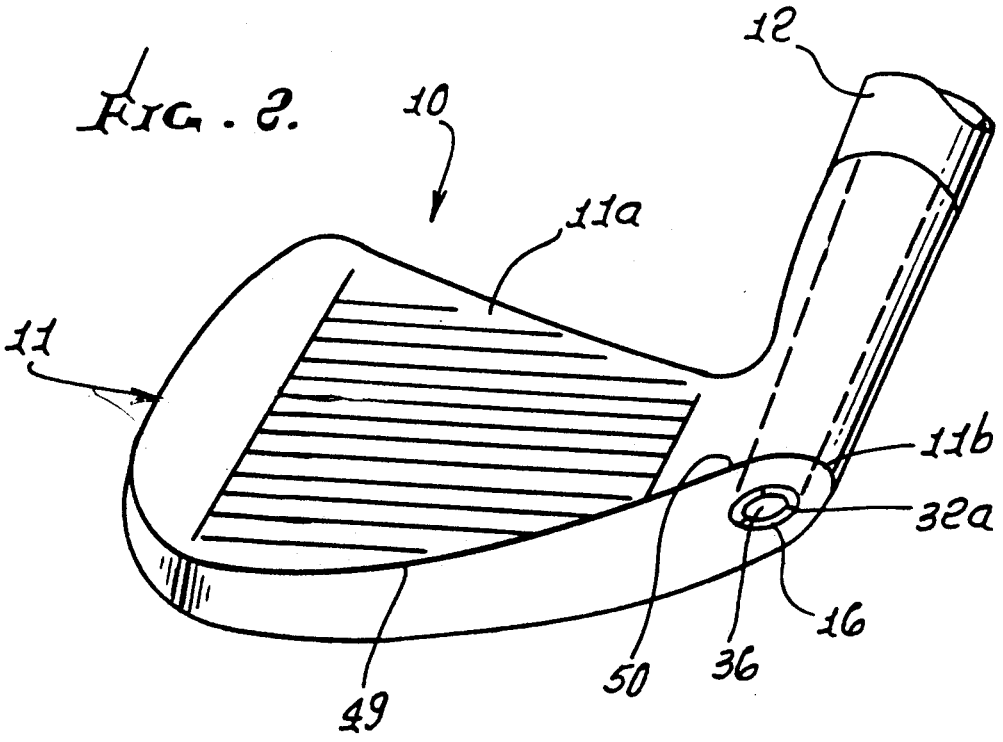
FIG. 2 is a perspective view of the front and bottom of the FIG. 1 head.
Figure 3:
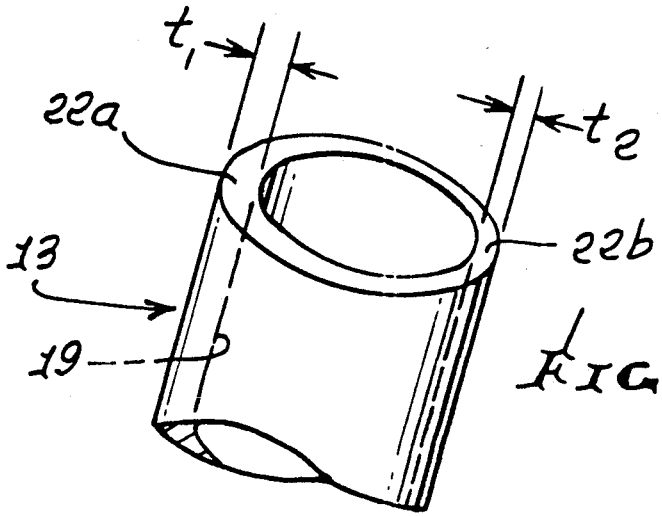
FIG. 3 is a perspective view of a mid-upper section of the hosel.

Yet another feature of the invention is the provision of a shaft lower end portion forcibly received into the socket, that shaft lower end portion having recess means whereby the lower end portion is collapsed at least in part into the recess means in response to its forcible reception into the socket. To this end, the lower end portion 30 of shaft 31 may advantageously have circularly spaced, cantilevered sections 32 which extend endwise, and have lower free ends or terminals 33, as seen in FIG. 6. Endwise extending slots 34 are formed between the metallic sections or tongues 32 to allow closure together of the sections (see FIG. 6*a*) when the sections are frictionally jammed downwardly into the tapered socket. Three to eight slots are workable. Note in FIG. 6*a* that the edges 32*a* of successive tongues may interengage at their lowermost locations 32*a'*. See also FIGS. 1 and 2. Such edge interengagement or near interengagement occurs at or near the intersection locus 16; and a plug 36 of material may be filled into the central opening 37 formed by the closing sections. In such instances, the shaft may not physically intersect the head sole itself, although the theoretical intersection still exists. A suitable plastic or powdered metal plug may be used. Also, the lower end portion 30 of the shaft may be bonded to the hosel and socket inner walls, as by a suitable bonding agent, epoxy being one example. Thus a positively jammed together and bonded connection is provided. Shaft 31 typically consists of steel.

If the lowermost ends of the cantilever sections project below the intersection 16 upon assembly, they may be trimmed off, as by grinding.

Accordingly, a very strong, sturdy connection of the shaft to the head is provided, facilitating maximum reallocation or location of weight to or at the head itself, with maximum feel, as well as maintaining continuity of the hosel leading edge 48, and face leading edge 49, with no intersection of exit hole 16 interfering at juncture 50, 51, should such intersection at 16 exist.

The head typically comprises a metal (steel) casting, with:

a) the head being a cast metal head having a socket with an inner wall tapering in an endwise direction generally toward the bottom of the head, b) the shaft having a lower end portion forcibly received into the socket, the lower end portion deformed by and against the tapering inner wall, which defines casting irregularities acting to further deform the shaft lower end portion.

Likewise, the method of forming shaft to head connection includes:

a) casting the head to have a bore tapering downwardly with variable taper, b) forcing the shaft lower end portion downwardly, into the variably tapered bore to effect partial collapse of the shaft lower end portion against the tapered bore.

Also, the head is typically cast to form surface irregularities at the bore, and against which the shaft lower end portion becomes deformed, as well as locked against twist relative to the bore.

In FIGS. 8 and 9, a graphite shaft 60 is tubular and defines a cylindrical bore 61 having an axis 62. The shaft has a lower portion 60*a* below a plane 63 normal to axis 62, that lower portion 60*a* tapering toward the lowermost end 60*b* of the shaft. The shaft wall thickness is greater at one side of the bore (see wall section 64) than at the opposite side of the bore (see wall thickness 65 below level of plane 63). As shown in FIG. 9, the wall section 65 has an outer surface 65*a* that tapers, toward end 60*b*, whereas wall section 64 has outer surface 64*a* that is parallel to axis 62. The degree of taper of the shaft surfaces between 65*a* and 64*a* decreases from 65*a* to 64*a*, about the axis 62.

FIG. 10 shows the graphite shaft assembled into the hosel socket 66 in iron club head 67. The hosel socket has an upper bore 68, which is cylindrical, to receive cylindrical shaft extent 69 above plane 63. The socket also has a lower bore 70, which is tapered to match the taper of the shaft lower portion 60*a*. Thus, the hosel socket lower portion also defines an axis, corresponding to axis 62, and has an inner wall 70*a* tapering relative to that axis in an endwise direction to receive and seat the shaft tapered surface 65*a*. Socket opposite wall 73 receives sideward jamming engagement with the shaft wall surface 64*a*, as a result of jamming of shaft surface 65*a* against hosel tapered wall 70*a*. Adhesive, such as epoxy, may be used to bond the shaft and hosel walls together. The shaft tapered wall 65 faces forwardly, i.e., in the same direction as the head ball-striking face 82, i.e., in the direction of head swing.

Upon assembly, the protruding lowermost end 60*b* of the graphite shaft is typically ground off to produce the shaft flush end 60*f* in FIG. 11; and filler 80 may be introduced into the shaft bore lower end to close and seal the bore, and produce a smooth surfaced, lower surface of the head. The head itself may consist of metal, such as steel.

We claim:

1. In a golf club having a head and a shaft having an axis, the head having a top and a bottom, an improved connection of the shaft to the head comprising in combination:

a) a socket associated with the head, the socket having an inner wall tapering in an endwise direction generally toward the bottom of the head, b) the shaft having a lower end portion with sections forcibly received endwise into said socket, c) the shaft lower end portion sections collapsed at least in part toward said axis in response to said forcible reception of the shaft lower end portion into the socket, d) said shaft collapsed lower end portion sections extending to locations between said top and bottom of the head.

2. The combination of claim 1 wherein said socket has an oval-shaped intersection with the bottom of the head, said shaft lower end portion extending substantially to said intersection.

3. The combination of claim 1 wherein the head has an upstanding hosel defining a shaft receiving bore, the bore aligned with said socket.

4. The combination of claim 3 wherein the hosel has an outer surface which is generally cylindrical, and wherein said bore is eccentric relative to the hosel outer surface.

5. The combination of claim 4 wherein the head has a ball-striking face which faces forwardly, and said hosel has a wall thickness which is greater at a forward facing side of the hosel, and lesser at a rearward facing side of the hosel.

6. The combination of claim 4 wherein said shaft lower end portion sections are generally circularly spaced apart.

7. The combination of claim 6 wherein said sections taper endwise toward said axis.

8. The combination of claim 7 wherein said shaft has a lower end and said sections are collapsed toward said axis, progressively toward the lower end of the shaft.

9. The combination of claim 1 wherein the head has a ball-striking face which faces forwardly, and said socket inner wall has forward and rearward sides, the forward side of said inner wall having a relatively greater taper angularity than the rearward side of said inner wall.

10. The combination of claim 1 wherein said head is a golf club iron head.

11. The combination of claim 1 wherein the shaft, when received into the socket, has varying endwise taper adjacent the socket.

12. In a golf club having a head and a shaft, said head having a bottom, an improved connection of the shaft to the head comprising in combination:

a) an upstanding hosel defining a shaft receiving bore, said bore having a lower extent which tapers downwardly, b) the hosel having an outer surface which is generally cylindrical, and wherein said bore lower extent is eccentric relative to the hosel outer surface, c) the head having a ball-striking face which faces forwardly, and said hosel lower extent having a wall thickness which is greater at one side of the hosel, and lesser at another side of the hosel, d) said bore defining a socket, the shaft having a lower end portion having associated recess means, said lower end portion defining sections collapsed at least in part toward said recess means in response to forcible reception of said shaft lower end portion into the socket and in engagement with said eccentric bore.

13. The combination of claim 12 wherein the shaft lower end portion sections define endwise extending, circularly spaced tongues circularly collapsed at least in part relatively toward one another in response to engagement of said tongues with said socket taper, said socket and said circularly collapsed tongues extending substantially to the bottom of the head.

14. The combination of claim 13 wherein said head has a ball-striking face which faces forwardly, and said socket inner wall has forward and rearward sides, the forward side of said inner wall having a relatively greater taper angularity than the rearward side of said inner wall.

15. The combination of claim 12 wherein said bore, relative to the hosel outer surface of the hosel is one of the following:

i) non-constant, in cross section ii) circular, in cross section.

16. The combination of claim 12 wherein the hosel outer surface is conical.

17. The combination of claim 12 wherein said head is a golf club iron head.

18. The combination of claim 12 wherein the shaft, when received into the socket, has varying endwise taper adjacent the socket.

19. In a golf club having a head and a shaft, the head having a bottom, an improved connection of the shaft to the head comprising in combination:

a) a hosel having an outer surface and a socket in the hosel and associated with the head, the socket having an inner wall tapering in an endwise direction generally toward the bottom of the head, b) the shaft having a lower end portion forcibly received endwise into said socket, c) the shaft lower end portion having sections defining recess means whereby said lower end portion is deflected at least in part into said recess means in response to said forcible reception into the socket, d) the shaft lower end portion sections deflected to a greater extent at one side of said recess means and to a lesser extent at an opposite side of said recess means, e) the socket extending to a location proximate said bottom of the head.

20. The combination of claim 12 wherein said socket has a generally oval-shaped intersection with the bottom of the head, said shaft lower end portion extending substantially to said intersection.

21. In a golf club having a head and a shaft adapted to be swung in a forward direction, the head having a bottom, an improved connection of the shaft to the head comprising in combination:

a) a hosel having a socket with an inner wall tapering in an endwise direction generally toward the bottom of the head, said wall defining a bore which intersects the bottom of the head, b) the shaft having a lower end portion forcibly received into the socket, said lower end portion deformed by and against said tapering inner wall, which defines casting irregularities acting to further deform the shaft lower end portion, c) said shaft lower end portion defining collapsed cantilevered sections.

22. In a golf club having a head and a graphite shaft, the head having a bottom, an improved connection of the graphite shaft to the head, comprising in combination:

a) the head having a hosel socket defining an axis, and with an inner wall tapering relative to said axis in an endwise direction generally toward the bottom of the head, b) the graphite shaft having a tapered lower end portion received into the socket and connected thereto, c) the graphite shaft lower end portion defining a bore and having a wall dimension which is greater at one side of the bore than at an opposite side of the bore, d) said shaft lower end portion extending to a location in the head proximate the bottom of the head.

23. The combination of claim 22 wherein the shaft lower end portion has a lowermost end, and an outer, generally annular, surface which tapers toward said lowermost end of the shaft.

24. In a golf club having a head and a shaft, the head having a top, a bottom, a heel and toe, an improved connection of the shaft to the head comprising, in combination a) the head having a hosel socket within the head between the top and bottom of the head, b) the shaft having a lower end portion received in the socket between the top and bottom of the head, said lower end portion having walls collapsed relatively toward one another by frictional engagement with the socket in the head.

25. In a golf club head having a top, a bottom, a heel and toe, and a hosel, and a forwardly facing, ball-striking face, the improvement comprising a) the hosel having an upwardly open socket that extends downwardly in the hosel below the level of the head top, b) the hosel having a forwardly tapering surface that tapers downwardly and rearwardly, c) said socket having a forward side spaced rearwardly from said hosel tapering surface, the socket forward side also tapering downwardly and rearwardly, d) whereby the socket is adapted to downwardly receive the lower end of a club shaft and to deflect a part of said shaft lower end rearwardly.

26. The improvement of claim 25 wherein said socket has a cylindrical upper portion and a downwardly tapering lower portion defining said socket forward side that tapers downwardly and rearwardly.

27. The improvement of claim 26 wherein said socket lower portion extends eccentrically relative to said socket upper portion.

28. The improvement of claim 26 wherein said socket lower portion has a rearward side which tapers downwardly and forwardly.

29. The improvement of claim 25 including said shaft having said lower end thereof received in the socket with interference, said shaft lower end part deflected rearwardly.

30. The improvement of claim 25 wherein said shaft lower end has relatively movable sections one of which defines said shaft lower end part.

31. In a golf club head having a top, a bottom, a heel and toe, and a hosel, and a forwardly facing, ball-striking face, the improvement comprising a) the hosel having an upwardly open socket that extends downwardly in the hosel below the level of the head top, b) the socket having a cylindrical upper portion and a downwardly tapering lower portion, c) the socket lower portion having opposite sides tapering downwardly, one of said sides having greater taper angularity than the other side, d) whereby the socket is adapted to downwardly receive the lower end of a club shaft and to deflect a part of said shaft lower end rearwardly.

32. The combination of claim 31 wherein one of said sides is spaced forwardly of the other.

33. The combination of claim 32 including said shaft having said lower end thereof received in the socket with interference, with opposite sides of the shaft lower end collapsed toward one another by downward engagement against said socket opposite sides.

34. The combination of claim 33 wherein said shaft lower end has relatively movable section one of which defines said shaft lower end part.

* * * * *